United States Patent [19]

Fujikawa

[11] Patent Number: 4,530,297

[45] Date of Patent: Jul. 23, 1985

[54] SPEED CONTROL APPARATUS FOR SEWING MACHINE

[75] Inventor: Katsuhiro Fujikawa, Aichi, Japan

[73] Assignee: Mitsubishi Denki Kabushiki Kaisha, Tokyo, Japan

[21] Appl. No.: 573,754

[22] Filed: Jan. 25, 1984

[30] Foreign Application Priority Data

Jan. 25, 1983 [JP] Japan ..... 58-10128

[51] Int. Cl.[3] ..... D05B 69/22

[52] U.S. Cl. ..... 112/275

[58] Field of Search ..... 112/275, 274, 277, 271

[56] References Cited

U.S. PATENT DOCUMENTS

| | | | |
|---|---|---|---|
| 4,195,582 | 4/1980 | Novick et al. | 112/275 X |
| 4,391,215 | 7/1983 | Sansone | 112/275 |
| 4,403,563 | 9/1983 | Schinozaki et al. | 112/275 |

*Primary Examiner*—H. Hampton Hunter

*Attorney, Agent, or Firm*—Sughrue, Mion, Zinn, Macpeak, and Seas

[57] ABSTRACT

A speed control apparatus for a sewing machine in which two separate circuits are provided for controlling driving, braking and stopping of the sewing machine. An output of one of the speed setting circuits is selected and applied for driving, braking and stopping the sewing machine. Operating levels for the two speed setting circuits are independently adjustable.

11 Claims, 3 Drawing Figures

SPEED CONTROL APPARATUS FOR SEWING MACHINE

BACKGROUND OF THE INVENTION

The present invention relates to a speed control apparatus for a sewing machine capable of operating at at least two speeds.

In a conventional speed control apparatus for a sewing machine, a voltage having a magnitude determined by the amount of depression of a pedal of the sewing machine is converted to a pulse signal (hereinafter referred to as an FG signal) having a pulse frequency related to the rotational speed of the sewing machine is produced, the number of the pulses of the FG signal is counted during periods between PG signal pulses and the current flowing through a clutch coil functioning as a driving mechanism or through a brake coil functioning as a brake mechanism is actuated when the counted value exceeds a predetermined value. The conventional circuit used for producing the FG signal has two input terminals, and the frequency of the FG signal is determined by the external inputs applied to the two input terminals. One of the two input terminals receives the voltage corresponding to the amount of depression of the pedal, and the other a voltage which effects driving of the sewing machine at a predetermined speed and which is independent of the voltage applied to the first input terminal. The two input terminals are hereinafter referred to as terminal VC and terminal L respectively.

In the conventional apparatus, two currents $I_a$ and $I_b$ are produced in correspondence to the voltages applied to the terminals VC and L, a capacitor is charged by the currents $I_a$ and $I_b$, and the FG signal is produced in response to the charging and discharging of the capacitor. However, since the capacitor is connected in common to the terminals VC and L, it is necessary to adjust the frequency of the FG signal by providing two variable resistors, one for adjusting the current $I_a$ generated in response to the input on the terminal VC and the other for adjusting the current $I_b$ generated in response to the input on the terminal L.

However, in the conventional apparatus, the capacitor is charged by both currents $I_a$ and $I_b$ when an active signal is applied to the input terminal VC, while only the current $I_b$ is supplied to the capacitor to charge it when an active signal is applied to the terminal L. Therefore, when the current $I_b$ is adjusted by the variable resistor as mentioned above, the sum of the currents $I_a$ and $I_b$ applied to the capacitor when the terminal VC receives an input is undesirably changed, thereby changing the output frequency. Under these circumstances, it is necessary to readjust the current $I_b$ with the other variable resistor. As a result, it is impossible in the conventional apparatus to adjust the output frequency of the FG signal independently with both variable resistors.

Further, the conventional apparatus has disadvantage that the current for charging the capacitor is the sum of the currents $I_a$ and $I_b$. Thus, the capacitor is usually charged by a current above the level of the current $I_b$, which results in the speed set by the variable resistor for adjusting the current $I_a$ usually being higher than the speed set by the variable resistor for adjusting the current $I_b$.

SUMMARY OF THE INVENTION

An object of the present invention is thus to provide a speed control apparatus for a sewing machine in which the above-mentioned disadvantages of the conventional apparatus are eliminated.

This object of the present invention is achieved by a speed control apparatus for a sewing machine including a driving mechanism for driving the sewing machine, a brake mechanism for controlling or stopping the sewing machine, detecting means for detecting at least the speed of the sewing machine and the position of the needle, and control means for controlling the driving mechanism and the brake mechanism with signals produced by the detecting means and command means. In accordance with the invention, the control means has at least two types of speed setting circuits, a switching circuit for switching the speed setting circuits to operate them independently, and an output portion for producing a control signal in response to the output from the chosen circuit.

DESCRIPTION OF THE PREFERRED EMBODIMENTS

A preferred embodiment of the present invention will be explained hereinafter with reference to the drawings.

Figure 1:
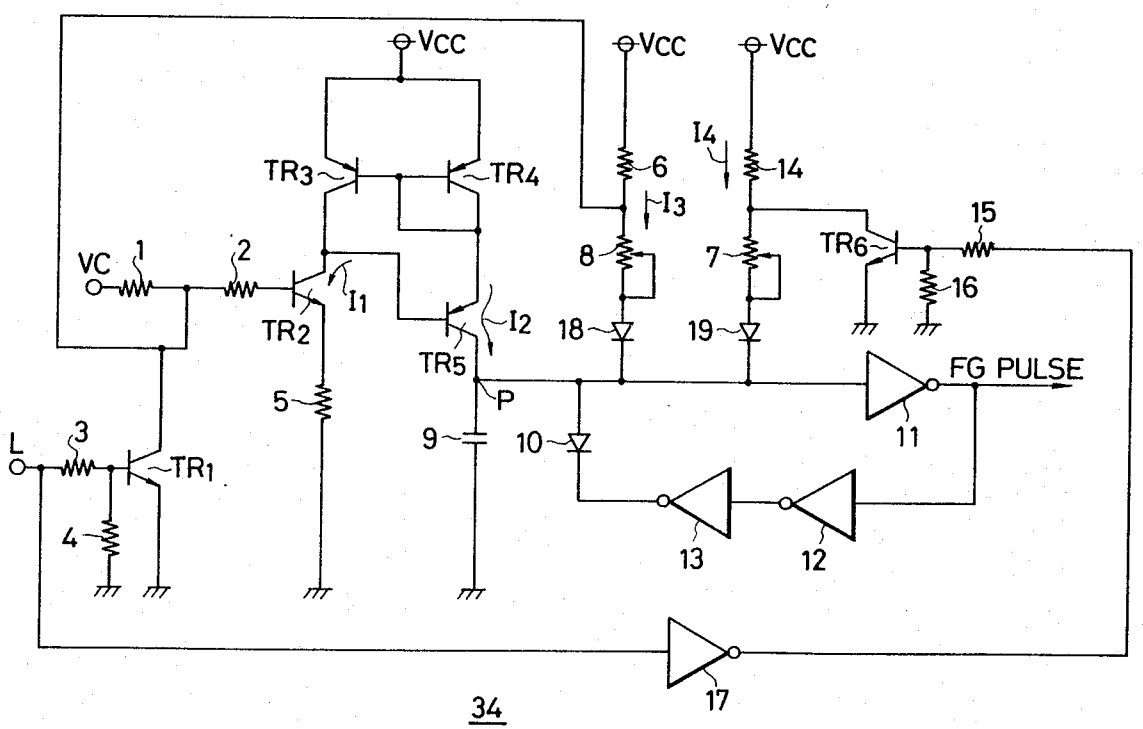
FIG. 1 is a circuit diagram of a preferred embodiment of a speed command circuit for a sewing machine of the present invention.

Referring to FIG. 1, a circuit diagram of a speed command circuit of the present invention is shown. In FIG. 1, VC designates a terminal supplied with a voltage corresponding to an amount of depression of a pedal and L designates an input terminal supplied with signal for setting the speed of the sewing machine at, for example, a moderate speed, a high speed, and a low speed, independent of the voltage applied to the terminal VC. For example, the speed may be high when the signal applied to the terminal L is at a high level H. Reference numerals 1 to 6 and 4 to 16 designate fixed resistors; $TR_1$ to $TR_5$, transistors; 7 and 8, variable resistors for setting the speed of the sewing machine; 9, a capacitor; 10, 18 and 19, diodes; and 11, 12, 13 and 17, inverters.

Figure 2:
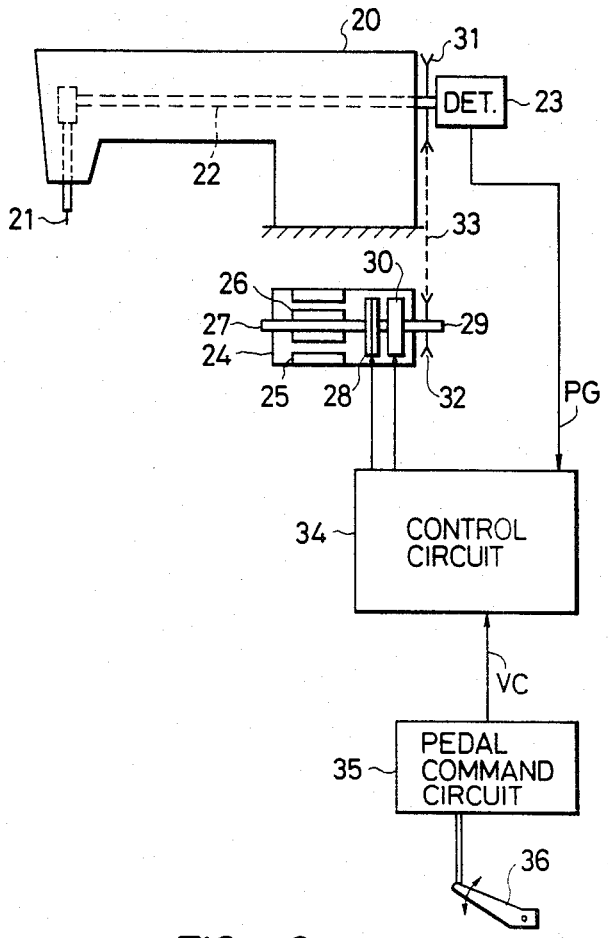
FIG. 2 shows the connection of the speed command circuit of FIG. 1 to a sewing machine.

Referring now to FIG. 2, the connection of the speed control apparatus to a sewing machine is shown. In FIG. 2, reference numeral 20 designates a body of the sewing machine having a shaft 22 which drives a needle 21, and reference numeral 23 designates a detector mounted on the shaft 22 of the sewing machine body 20 for generating a pulse signal (the PG signal) having a pulse frequency corresponding to the rotational speed of the shaft 22 and the position of the needle of the sewing machine. Reference numeral 24 designates a motor having a stator 25 and a rotor 26 for driving the sewing machine. The output of the shaft 27 of the motor 24 is transmitted to an output shaft 29 through an electromagnetic clutch device 28. Reference numeral 30 designates an electromagnetic brake device; 31 and 32, pulleys; and 33, a belt through which the sewing machine 20 is driven by the motor 24. Reference numeral 34 designates a control circuit including the speed command circuit for the sewing machine shown in FIG. 1.

The control circuit 34 receives the PG signal from the detector 23 and the output signal (VC signal) from the pedal command circuit 35, generating in response thereto a voltage corresponding to the amount of depression of the pedal 36 and a control curent supplied to an energization coil of the electromagnetic clutch device 28 or an energization coil of the electromagnetic brake device 30.

In operation, the command voltage from the pedal command circuit 35 is applied to the terminal VC. The transistors $TR_2$, $TR_3$, $TR_4$ and $TR_5$ operate in response to that voltage. Upon an increase of the command voltage at the terminal VC, the collector current $I_1$ of the transistor $TR_2$ is increased, and hence the collector current $I_2$ of the transistor $TR_4$ also increases. That is the collector current $I_2$ of the transistor $TR_4$ is increased or decreased in proportion to the collector curent $I_1$. Therefore, the current which charges the capacitor 9, that is, the collector curent $I_2$, changes in accordance with the changes of the command voltage at the terminal VC.

In the case where the voltage of the terminal L is at a low level, the transistor $TR_1$ is cut off and the transistor $TR_6$ is turned on, in which case the capacitor 9 is charged by the current $I_3$. Therefore, the speed corresponding to the maximum voltage of the terminal VC can be adjusted by adjusting the variable resistor 8. A diode 19 prevents the current $I_3$ from flowing through the transistor $TR_6$. The capacitor 9 is then charged by the sum of the collector current $I_2$ of the transistor $TR_5$ and the curent $I_3$ flowing through the resistor 6. When the voltage at the point P approaches the power source voltage $V_{cc}$, exceeding the treshold voltage $V_{TH}$ of an inverter 11, the output of the inverter 11 is inverted to be an L (low) level after a transmission lag time t between the inverters. Thus, the charge of the capacitor 9, charged to the threshold voltage $V_{TH}$, is absorbed in the inverter 13 through the diode 10, whereupon the input of the inverter 11 again becomes an L level and the discharge of the capacitor 9 is stopped. Then, the capacitor 9 is again charged by the sum of the collector current $I_2$ and the current $I_3$. If the collector current $I_2$ is increased, the time required for charging the capacitor 9 is reduced, thereby varying the output frequency. As mentioned above, changes in the voltage at the terminal VC result in corresponding changes in the frequency of the PG signal.

Figure 3:
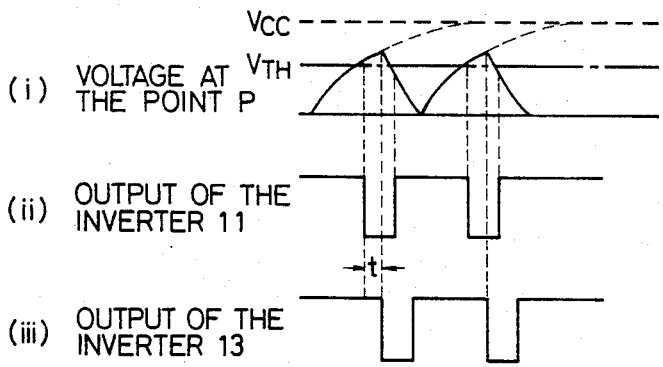
FIG. 3 shows waveforms in the circuit of FIG. 1.

Referring now to FIG. 3, waveforms are shown at various points in the above-discussed circuit. In FIG. 3, the voltage at the point P is shown at (i), and at (ii) and (iii) are shown the outputs of the inverters 11 and 13, respectively. t denotes a time delay between the inverters 11 and 13; $V_{cc}$, the power source voltage; and $V_{TH}$, the threshold voltage of the inverter 11.

The above description relates to the case where the input terminal L receives a signal at a low level L. On the other hand, in the case where a high level signed H is present at the input terminal L, the transistor $TR_1$ turns on and the transistor $TR_6$ turns off. In this state, the capacitor 9 is charged only by the current $I_4$, and therefore the speed of the sewing machine, as set by the frequency of the PG signal, and can be adjusted by adjusting the variable resistor 7 and is independent of the voltage at the terminal VC and the setting of the variable resistor 8. Also, in this state, the diode 18 prevents the current $I_4$ from flowing through the transistor $TR_1$. According to the selection of the values of the resistors 6 and 14 and the settings of the variable resistors 7 and 8, the speed set by the variable resistor 7 may be a level above that set by the variable resistor 8.

In the above described embodiment, the speed can be set with two sources, but it is also possible to independently set the speed with three or more sources by appropriately adding fixed resistors, variable resistors, diodes, and transistors. Further, similar advantages to the above can be obtained by using an analog switch or the like.

I claim:

1. A speed control apparatus for a sewing machine, comprising:

(a) means for driving said sewing machine;

(b) means for braking said sewing machine to control and stop said sewing machine;

(c) means for detecting the speed of said sewing machine and the position of a needle of said sewing machine; and (d) control means for controlling said driving means and said braking means in accordance with output signals from said detector and command signals from command means, said control means comprising at least first and second independently operating speed setting circuits, a switching circuit for selecting an output of one of said speed setting circuits, and means for applying the output selected by said switching circuit as a speed control signal to at least one of said driving means and said braking means.

2. The speed control apparatus for a sewing machine according to claim 1, wherein said first and second speed setting circuits each comprise means for adjusting a speed controlling parameter of said selected output.

3. The speed control apparatus for a sewing machine according to claim 1, wherein said driving mechanism comprises an electric motor having an electromagnetic clutch device, and wherein said speed control signal is applied to an energization coil of said electromagnetic clutch.

4. The speed control apparatus for a sewing machine according to claim 1, wherein said brake means comprises an electric motor having an electromagnetic brake device, and wherein said speed control signal is applied to an energization coil of said electromagnetic brake device.

5. The speed control apparatus for a sewing machine according to claim 1, wherein said first and second speed control circuits comprise, respectively, first circuit means for producing a first output signal having a parametric value determined in accordance with said command signals from said command means, and second circuit means for producing a second output signal having a parametric value independent of said first output signal.

6. The speed control apparatus for a sewing machine according to claim 1, wherein said switching circuit comprises a semiconductor switching element for providing as said selected output one of said first and second output signals.

7. The speed control apparatus for a sewing machine according to claim 1, wherein each of said first and second speed setting circuits comprises means for adjusting a current inputted to said speed control signal applying means, said speed control signal applying means comprising a capacitor coupled to be charged by current set by said adjusting means, the frequency of said speed control signal being adjusted by changing a